United States Patent [19]

Roberts et al.

[11] 4,421,630

[45] Dec. 20, 1983

[54] PROCESS FOR COAL LIQUEFACTION IN STAGED DISSOLVERS

[75] Inventors: George W. Roberts, Emmaus; Edwin N. Givens, Bethlehem; Ronald W. Skinner, Allentown, all of Pa.

[73] Assignee: International Coal Refining Company, Allentown, Pa.

[21] Appl. No.: 308,639

[22] Filed: Oct. 5, 1981

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,583,900 | 6/1971 | Gatsis | 208/8 LE |
| 3,884,796 | 5/1975 | Hinderliter et al. | 208/8 LE |
| 3,892,654 | 7/1975 | Wright et al. | 208/8 LE |
| 4,162,956 | 7/1979 | Rhodes | 208/8 LE |
| 4,164,466 | 8/1979 | Baldwin et al. | 208/8 LE X |
| 4,222,844 | 9/1980 | Nizanoff | 208/8 LE |
| 4,300,996 | 11/1981 | Kuehler | 208/8 LE X |
| 4,325,800 | 4/1982 | Rosenthal et al. | 208/8 LE |
| 4,330,389 | 5/1982 | Rosenthal et al. | 208/8 LE X |

*Primary Examiner*—Delbert E. Gantz
*Assistant Examiner*—William G. Wright
*Attorney, Agent, or Firm*—Mark F. Wachter

[57] ABSTRACT

There is described an improved liquefaction process by which coal is converted to a low ash and low sulfur carbonaceous material that can be used as a fuel in an environmentally acceptable manner without costly gas scrubbing equipment. In the process, coal is slurried with a pasting oil, passed through a preheater and at least two dissolvers in series in the presence of hydrogen-rich gases at elevated temperatures and pressures. Solids, including mineral ash and unconverted coal macerals, are separated from the condensed reactor effluent. In accordance with the improved process, the first dissolver is operated at a higher temperature than the second dissolver. This temperature sequence produces improved product selectivity and permits the incorporation of sufficient hydrogen in the solvent for adequate recycle operations.

15 Claims, 1 Drawing Figure

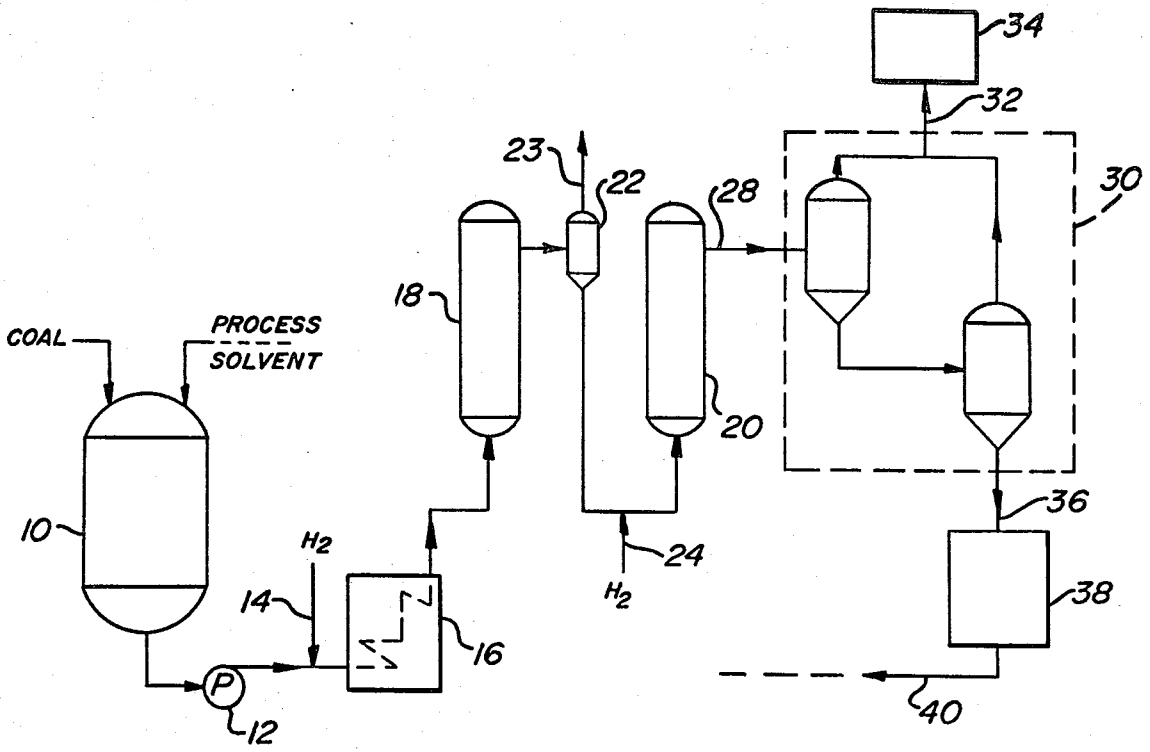
PROCESS SOLVENT
COAL
10
12
P
14
$H_2$
16
18
23
22
28
20
24
$H_2$
34
32
30
36
38
40

PROCESS FOR COAL LIQUEFACTION IN STAGED DISSOLVERS

The Government of the United States of America has rights in this invention pursuant to Contract No. DE-AC05-780R03054 (as modified) awarded by the U.S. Department of Energy.

BACKGROUND OF THE INVENTION

This invention relates to a process for the solvent refining of coal wherein coal is liquefied by subjecting it to a hydrogen donor solvent (solvent) in the presence of a hydrogen-rich gas at elevated temperatures and pressures. This process is referred to in the art as SRC-I, solvent refined coal having the acronym "SRC". In this process, following solvation, the products are separated into gaseous material, distillate fractions and vacuum distillation bottoms. The vacuum distillation bottoms, which contain entrained mineral matter and unconverted coal macerals, are separated in a deashing step. From the solids removal step there is recovered a stream of coal products which are free of ash minerals and unconverted coal and which are essentially low in sulfur content, such that this material is ideally suited for combustion in environmentally acceptable operations.

In the operation of a coal liquefaction complex for the process of the above-indicated type, the dissolving section must be capable of generating sufficient process solvents to meet the solvent demands of the plant. Not only must adequate supplies be met, but also the quality of this solvent must be kept at a level such that the process will continue to operate.

The SRC-I pilot plants at Wilsonville, Ala. and Fort Lewis, Wash. have been operated only with a single coal liquefaction reactor (also known as the dissolver) preceded by a preheater. The coal liquefaction reactions take place to some extent in both of these vessels. A slurry of coal in recycled solvent under hydrogen pressure is passed through the preheater, where its temperature is raised from ambient to temperatures up to 800° F. For a typical dissolver outlet temperature of 825° F., the preheater outlet temperature would be about 775° F. The residence time in the preheater is about five minutes. About 85% of the raw coal is dissolved at the preheater exit, but other reactions (desulfurization, solvent production, etc.) do not occur to any major extent in the preheater. The heated slurry then passes to the dissolver, where the bulk of the other liquefaction reactions (desulfurization, solvent production, solvent rehydrogenation, etc.) take place.

SUMMARY OF THE INVENTION

It is the general object of the invention to provide a solvent refined coal process of the indicated type wherein by employing proper process conditions, not only can the solvent balance of the plant be met, but also the quality of the solvent can be maintained. To this end, the process of the invention employs a preheater and at least two dissolvers in series. The first dissolver is preceded by the preheater and operates at a high temperature to achieve the benefits of small reactor size, low SRC sulfur content, low preasphaltene concentration, and high net production of recycled solvent. The second dissolver operates at a lower temperature which is more favorable thermodynamically for solvent hydrogenation, the major function of the second dissolver being to rehydrogenate and "upgrade" the hydrogen deficient solvent that exits the first dissolver.

PRIOR ART

Various patents disclose processes utilizing multistage liquefaction processing equipment, such patents including U.S. Pat. Nos. 3,640,816; 4,189,371; 3,884,794; 3,884,795 and 4,085,031. None of these patents teaches a solvent refined coal process of the above-indicated type in which two dissolvers are used in series with the first dissolver operating at a higher temperature than the second in conjunction with a conventional preheater. For example, U.S. Pat. Nos. 3,884,794 and 3,884,795 disclose SRC-type processes in which the preheater outlet temperature is maintained higher than the average dissolver temperature. The patents describe a process requiring a very close approach to plug flow in the preheater (i.e., a length to diameter ratio greater than 100), and also require that the viscosity of the slurry go through a maximum and then minimum before the slurry exits the preheater. Experimental data cited in these patents shows preheater temperatures ranging from 840° F. to 930° F. with average dissolver temperatures 45° F. to 90° F. lower. Preheater outlet temperatures in this region are expensive to achieve in that they require a larger surface area and/or a reduced overall thermal efficiency due to higher preheater furnace temperatures.

BRIEF DESCRIPTION OF THE DRAWING

The single FIGURE in the drawing shows a schematic flow diagram of the preferred embodiment of the invention.

DETAILED DESCRIPTION OF THE PREFERRED EMBODIMENTS

Feed coal to this process may be of any rank lower than anthracite, such as bituminous, sub-bituminous or lignite coals or mixtures thereof. The feed coal may be used directly from the mine (run-of-mine coal), or may be precleaned to any of several levels to remove a portion of the entrained mineral matter. The coal, either run-of-mine or from a coal preparation plant, may be ground to a size typically less than 8 mesh (Tyler Screen Classification), or more preferentially less than 20 mesh, and dried to remove substantial moisture to a level for bituminous or sub-bituminous coals of less than 4 weight percent.

In this process coal is slurried with a solvent which may be comprised of a coal-derived oil, obtained in the coking of coals in a slot oven, commonly referred to as creosote oil, anthracene oil, or of equivalent type, or it may be a process-derived solvent. Also contained in this solvent may be a residual SRC production fraction taken from a solids separation step such as from the second stage separation of a critical solvent deashing unit which can be employed if so desired. The fraction of the residual SRC in the solvent stream may be up to 35 percent of the total solvent.

The coal is mixed with the process solvent in a coal slurry mix tank 10 at temperatures from ambient to 450° F. and concentrations of coal in the slurry of 20–55% by weight. In the slurry mix tank 10, which may be maintained at elevated temperatures to keep the viscosity of the solvent low enough to pump, a portion of the moisture entrained in the feed coal will be removed. Maintaining the tank at higher temperatures will allow moisture to escape as steam. The slurry from tank 10 is passed to a pumping unit 12 that forces the slurry into a system which is maintained at higher pressures usually from 500 to 3000 psig. The slurry is mixed with a hydrogen-rich gaseous stream, via line 14, at a ratio of from 10–40 Mscf per ton of feed coal. The three-phase gas/-slurry stream is then introduced into a preheater system comprised of a tubular reactor 16 having a length to diameter ratio greater than 200, and more preferably, greater than 500. The temperature of the three-phase mixture is increased from the appropriate temperature in the slurry tank to an exit temperature of 600°–850° F.

The preheated slurry is then passed to a coal liquefaction stage whereat the slurry is passed in series through two dissolvers. The dissolvers comprise tubular vessels 18 and 20 operated in an adiabatic mode without the addition of significant external heat. The length to diameter ratios of these dissolver vessels 18 and 20 are considerably less than employed in the preheater section of this process. The exit slurry from the preheater section contains little undissolved coal which thereby enters the first dissolver vessel 18. In the preheater section, the viscosity of the slurry changes as the slurry flows through the tube, forming initially a gel-like material which shortly thereafter diminishes sharply in viscosity to a relatively freely flowing fluid. This fluid then enters the dissolvers where other changes occur.

In the dissolvers the coal and solvent undergo a number of chemical transformations including, but not necessarily limited to: further dissolution of the coal; hydrogen transfer from the solvent to the coal; rehydrogenation of recycled solvent; removal of heteroatoms, including sulfur, nitrogen, and oxygen, from the coal and recycle solvent; reduction of certain components in the coal ash, e.g., $FeS_2$ to FeS; and hydrocracking of heavy coal liquids. The mineral matter in the coal can, in various extent, catalyze the above reactions.

The superficial flow through the dissolvers will generally be at a rate from 0.003 to 0.1 feet per second for the gas phase. These rates are chosen to maintain good agitation within the reactor which insures good mixing. The ratio of total hydrogen gas to slurry is maintained at a level to insure an adequate hydrogen concentration in the exit slurry to prevent coking. Specific selection of flow through the dissolvers is chosen such that the coal slurry with its incipient mineral particles move through the dissolvers with minimal entrainment of larger particles that are unable to exit the dissolvers. The quantity of solids that accumulate in the dissolvers at these velocities is quite small based on feed. In the preferred design, the concentration of solids in the dissolvers will serve to catalyze the reactions. Because of this inherent accumulation phenomenon, it is desirable that a solids withdrawal system be placed into the dissolvers so that excessive accumulated solids can be removed from the system.

The effluent from the first dissolver 18 is at a higher temperature than the temperature of the slurry leaving the preheater and entering the dissolver because of the exotherm that occurs upon hydrogenation of the materials contained therein. By taking advantage of this exotherm across the first dissolver 18, some of the heat load can be removed from the preheater which thereby increases the overall thermal efficiency of the plant. In the application of the concept of the process disclosed herein, the temperature of the slurry leaving the first dissolver 18 should be at a temperature from 840° to 895° F. This effluent stream is then passed to a second dissolver 20 after going through a gas separator 22. The effect of the separator 22 will be such as to remove the gas from the stream. When a gas separator is used, the hydrogen partial pressure is restored with a cooled hydrogen rich stream via line 24, before entering the second dissolver 20.

In accordance with the invention, the second dissolver is operated at a lower maximum temperature than the first dissolver. (As used herein, the term "operating" temperature of the dissolvers denotes the "maximum" temperature thereof unless otherwise specified.) In order to accomplish this, the inlet to the second dissolver will be at least 25° F. cooler than the exit temperature from the first dissolver 18. It will be apparent that various means may be used to achieve the required cooling effect. The injection of cold hydrogen to the second dissolver is one means of cooling the slurry; injection of cold solvent is another. This cooling effect can also be attained by passing the three-phase slurry through a heat exchanger to lower the temperature of the feed to the second stage by at least 25° F. Alternatively, both cold gas and/or liquid injection and a heat exchanger may be used to lower the temperature of the slurry stream.

The separator gaseous effluent, indicated at 23, if so desired after flashing, is passed to a gas system where ultimately the vapors are cooled and let down in pressure to recover the light gases, water and organic-rich condensate. These separations, collections and gas purification separations are accomplished in a gas treatment area where the overhead from the separator 22 is combined with the overhead from a separating zone 30 (to be described hereafter) at the terminus of the process.

The lower temperature stream is passed to the dissolver 20 at which time the three-phase gas-slurry mixture is remixed with fresh hydrogen by means of line 24 and injected into dissolver 20. Some of the cooling can be controlled by the temperature of the fresh hydrogen feed that is added to this vessel. Adequate hydrogen is fed to the second dissolver 20 to maintain good agitation in the reactor to insure good mixing. Introducing fresh hydrogen to the dissolver increases the hydrogen partial pressure significantly since much of the CO, $CO_2$ and water is removed after the first dissolver if a separator is used. Even if a separator is not used, the hydrogen partial pressure will still be greater. The higher hydrogen partial pressure will insure better reaction from higher conversion of the residual fractions to distillate and better hydrogen incorporation into the recycle solvent. This latter reaction is especially promoted by the lower temperature attained in the second dissolver. Under the preferred design the effluent from the second dissolver should be at least 25°–50° F. lower than the effluent from the first dissolver. The higher hydrogen partial pressure will also further promote sulfur removal.

The number of dissolvers in this process may be two or greater. Typically, the concentration of unconverted coal and SRC in the downstream dissolvers will be greater than in the first dissolver due to flashing of specific lower boiling material both in the feed and generated as the reaction proceeds. Having higher concentrations of the residue in these dissolvers provides thereby the capability of selectively treating this heavier fraction such that greater amounts of distillate can be produced.

The dissolver contents from the second or final dissolver are removed, led through line 28 into a vapor/-liquid separating zone, indicated at 30, where the effluent is flashed and the overhead is cooled to a range of 100°–150° F. in heat exchangers which may be in multiple stages, all which are well known in the art. Light gases, e.g., hydrogen $H_2S$, $CO_2$, ammonia, $H_2O$ and $C_1$–$C_4$ hydrocarbons are removed in the flashing operation and pass via line 32 to a hydrogen recovery section 34 whereat these gases are scrubbed to remove acidic and alkaline components, while the hydrogen and lower hydrocarbons may be recycled to various stages in the process or burned for fuel. A liquid/solid slurry is passed via line 36 through a distillation and solid-liquid separation system 38 where a plurality of streams are obtained; namely: (a) light distillates (up to 400° boiling point), (b) distillate (boiling from about 350°–1050° F.), (c) solvent refined coal (initial boiling point about 850° F.) plus recycle solvent, and (d) solid residue containing predominately ash and unconverted coal plus some SRC and solvent. The recycle solvent stream is recycled via line 40 to the coal feed to help make the initial coal/recycle solvent slurry.

In the process as disclosed here, which is comprised of a preheater and at least two dissolvers in series, maximum product benefit is obtained at minimum equipment cost. The first dissolver operates at a high temperature (about 840° F. or higher) to achieve the benefits of small reactor size, low SRC sulfur content, low preasphaltene concentration and high net production of recycle solvent. The second dissolver operates at a lower temperature which is more favorable thermodynamically for recycle solvent hydrogenation. The major function of the second dissolver is to rehydrogenate and "upgrade" the H/deficient recycle solvent that exits the first dissolver. However, some additional solvent production, SRC desulfurization, etc. does occur in the low temperature dissolver.

At steady state, the series combination of a high temperature dissolver followed by a low temperature dissolver requires less reactor volume and produces a lower sulfur and lower preasphaltene SRC than a single dissolver. The overall hydrogen consumption is comparable for the dual dissolver and single-dissolver systems. In this process, the net make of recycle solvent is controlled primarily by adjusting the temperature and residence time in the first dissolver. The quality of recycle solvent is controlled by adjusting the temperature and residence time in the second dissolver.

In accordance with one embodiment of this process it is proposed that a small, high temperature dissolver is used in between a conventional preheater and a larger, low temperature dissolver (i.e., the first dissolver has a smaller cross-sectional flow area than the second dissolver). This embodiment has a major economic advantage since it permits the use of a minimum sized fired preheater, which is one of the most expensive items of equipment in a coal liquefaction plant, by substituting a far less expensive per unit volume adiabatic dissolver. In this process as disclosed here, a fired preheater is not used to provide additional coal residence time, rather the inexpensive dissolver stage is used to allow the longer residence time necessary to attain the first stage reaction.

As will be apparent from the data presented hereinafter, operating the first dissolver at 840° F. to 895° F. produces a result that is superior to or equal to results observed at lower temperatures in all respects except in solvent quality. Because coal dissolution demands a large supply of free radical terminating agent, the hydrogen donating capacity of the recycle solvent is quickly depleted under process conditions when high coal concentrations are run. It is well understood that a high dissolver temperature will be less deleterious to recycle solvent quality if the ratio of coal to recycle solvent is reduced. However, such a process change would require a larger dissolver to process equivalent volumes of coal. Therefore it it concluded that degradation of solvent quality makes continuous operation at high temperatures infeasible if only one dissolver is employed. With a single dissolver, a lower reactor temperature must be used and its associated disadvantages, such as higher SRC sulfur concentration and higher preasphaltenes, must be accepted.

It will be appreciated that the above description is schematic and recites the essential operation of the process and that those skilled in the art will know where to supply and how to employ the necessary valves, pumps, pressure equipment and other standard engineering elements required in the system.

The invention will now be illustrated by reference to the following examples, although it is to be understood that these examples are illustrative only and are not intended to be limitative.

EXAMPLES 1–8

A 39% slurry of Kentucky 9/14 coal having the composition shown in Table I was prepared in a solvent comprised of a blend of creosote oil and hydrotreated creosote oil with a composition shown in Table II. In Examples 1 to 4 the feed slurry was fed to a reactor at a rate of 3 liters per hour in the presence of 550 liters per hour of hydrogen gas. As shown in Table III the reactor pressure was maintained at 2000 psig, the reactor temperatures were 786°, 821°, 862° and 891° F., respectively, and the nominal volume space velocity was 3 $hr^{-1}$. Examples 1–4 illustrate that higher temperatures favor higher distillate yields and lower SRC sulfur levels and that lower temperatures favor higher hydrogen levels in the resulting spent solvent.

In Examples 5 and 6 shown in Table IV, the effect of higher temperature at a shorter residence time of 2.1 $hr^{-1}$ (Ex. 6) is compared to lower temperature at longer residence time (Ex. 5). In both cases the slurry feed to the reactors was the same as in Examples 1–4. In Example 6, at the higher temperature, more distillate and a lower sulfur in SRC was observed. The solvent suffers a large drop in hydrogen content from 7.81% to 7.47%. In Example 5 operated at lower temperature and longer residence time, the solvent increased in hydrogen content.

In Examples 7 and 8 shown in Table IV the advantage of the invention claimed herein is again illustrated. This high temperature run in Example 8 illustrates an acceptable sulfur content in SRC plus a satisfactory distillate make. At the lower temperature in Example 7, the hydrogen content in the recycle solvent can be maintained at a level sufficient to carry on the process.

TABLE I

| Ultimate Analysis | % |
|---|---|
| Carbon | 67.67 |
| Hydrogen | 4.71 |
| Nitrogen | 1.48 |
| Sulfur | 3.20 |
| Oxygen | 12.12 |
| Ash | 10.82 |
| Moisture | 2.50 |

TABLE II

| Fraction | Wt. % | Composition of Solvent: Elemental Analysis (wt %) Carbon | Hydrogen | Nitrogen | Sulfur |
|---|---|---|---|---|---|
| IBP-420° F. | 5.62 | 87.03 | 10.59 | 0.05 | — |
| 420-550° F. | 48.61 | 89.66 | 8.41 | 0.35 | 0.19 |
| 550-850° F. | 42.70 | 90.90 | 7.13 | 0.36 | — |
| 850° F.+ | 3.07 | 88.99 | 6.35 | 1.52 | 3.20 |

TABLE III

| | Example 1 | Example 2 | Example 3 | Example 4 |
|---|---|---|---|---|
| Temperature, °F. | 786 | 821 | 862 | 891 |
| Pressure | 2000 | 2000 | 2000 | 2000 |
| Hydrogen Feed Rate, 1000 scf/ton Coal | 13.5 | 14.0 | 13.7 | 13.5 |
| Conversion, maf | 91.5 | 89.5 | 91.4 | 91.8 |
| Viscosity, cps | 18.8 | 10.0 | 6.4 | 5.2 |
| Hydrogen Consumption, wt % maf Coal | 1.0 | 1.2 | 1.6 | 1.4 |
| Product Distribution, wt % maf Coal | | | | |
| Gaseous Hydrocarbons | 0.6 | 1.9 | 3.8 | 6.4 |
| Distillate | −3.1 | 4.4 | 7.1 | 5.0 |
| SRC | 86.0 | 75.6 | 74.1 | 71.1 |
| Sulfur in SRC, wt % | 1.35 | 1.10 | 0.99 | 0.82 |
| Hydrogen in Solvent, wt % | | | | |
| Start | 7.81 | 7.81 | 7.81 | 7.81 |
| Finish | 7.72 | 7.59 | 7.38 | 7.38 |

TABLE IV

| | Example 5 | Example 6 | Example 7 | Example 8 |
|---|---|---|---|---|
| Temperature, °F. | 793 | 888 | 788 | 891 |
| Pressure | 2000 | 2000 | 2000 | 2000 |
| LHSV ($Hr^{-1}$) | 1.0 | 2.1 | 1.4 | 3.0 |
| Hydrogen Feed Rate, 1000 scf/ton Coal | 42.5 | 19.0 | 28.1 | 14.0 |
| Conversion, wt % maf Coal | 92.0 | 93.7 | 89.8 | 91.8 |
| Hydrogen Consumption, % maf Coal | 1.3 | 1.9 | 1.3 | 1.4 |
| Product Distribution, % maf Coal | | | | |
| Gaseous Hydrocarbons | 1.6 | 7.4 | 1.4 | 6.4 |
| Distillate | 5.0 | 13.2 | 3.7 | 5.0 |
| SRC | 76.4 | 62.8 | 76.6 | 71.1 |
| Sulfur in SRC, wt % | 1.1 | 0.6 | 1.2 | 0.8 |
| Hydrogen in Solvent, wt % | | | | |
| Start | 7.81 | 7.81 | 7.81 | 7.81 |
| Finish | 7.96 | 7.47 | 7.88 | 7.38 |

In Tables I-IV, "IBP" denotes initial boiling point, "maf" denotes moisture and ash free, and "LHSV" denotes superficial liquid hourly space velocity, which is the volume of slurry per volume of reactor per hour. While these terms are well known in the art, their definition is provided for the sake of clarification.

EXAMPLE 9

A preferred process in accordance with the invention is comprised of the following steps: (1) A coal is slurried by contacting the coal with solvent. (2) The slurry is pumped through a preheater in the presence of hydrogen rich gas at a total pressure of 2000 psig, the preheater having a length to diameter ratio of at least 200:1 for a residence time of 5 minutes with an outlet temperature being obtained at 800° F. (3) The slurry is then passed through two dissolver vessels in series, with additional fresh hydrogen being added to the slurry between the two vessels, the temperature of the effluent stream from the first dissolver being higher than the effluent temperature from the preheater so as to take advantage of the exotherm that occurs due to hydrogenation reactions that occur. (4) The effluent stream of the first dissolver is cooled by 50° F. so that the stream when passed to the second dissolver will see temperatures at least 25° F. lower than the maximum temperature in the first dissolver. (5) The reactant is retained in the process for 45 minutes, with the residence time in the high temperature dissolver being less than that in the lower temperature dissolver. (6) The effluent slurry from the second dissolver is passed through a separator from which a vaporous stream and a condensed product stream are separated, the ratio of which is dependent upon the temperature of the separator which may be maintained at 750° F. (7) The overhead product stream is passed to separation equipment which isolates a hydrogen rich stream that can be recycled to the dissolving section plus hydrocarbons which may be steam reformed, burned or sold as fuel. (8) The underflow from the separator is passed to a filtration system where the unconverted coal and ash are removed. The remaining liquid is passed to a vacuum distillation tower which is operated at temperatures from 600° F. at absolute pressures of 0.4 pounds/in$^2$, where there is isolated a distillate overhead comprised of light carbonaceous products plus a middle distillate which, when separated, is passed back to the slurry mix tank, and a residual bottoms product comprised of soluble dissolved coal (SRC), and residual process solvent.

EXAMPLE 10

In this example of the invention, the same process as described above in Example 9, except there is no filtration and the vacuum bottoms from the distillation are passed to a critical solvent deashing process wherein the feed is mixed with the critical deashing solvent at temperatures of from 450° F. to 630° F. and pressures from 750-1000 psig. This slurry is passed to a first separator from which light upper phase and lower heavy phase are separated. The lower phase is removed, which phase is comprised primarily of critical deashing solvent, which is recovered and returned to the critical solvent deashing mix tank, and an ash concentrate, which is comprised of solids, mineral ash residue, unconverted coal macerals and a small amount of solubilized coal. The light upper phase is passed to a second separator wherein a light phase (comprised of the critical deashing solvent and a light fraction of solubilized coal) and a heavy phase (comprised of solubilized coal) are separated to thereby isolate from said light phase, reusable critical deashing solvent, a light solvent refined coal product returnable to the coal slurry mix tank for use in the solvent, and a heavy solubilized coal product, most of which is considered a major product of the process and part of which may also be recycled to the coal slurry mix tank for incorporation into the pasting solvent.

It will be apparent from the foregoing description that an important feature of the process in accordance with the invention is that by operating the second dissolver at a lower temperature than the first dissolver the necessary step of regeneration of the hydrogen content of the solvent can be achieved so that coking problems are avoided. It is also to be noted that the operating of the two dissolvers at different temperatures is better than operating both dissolvers at the same high temperature or even at certain intermediate temperatures. Operation at high temperatures causes depletion of the hydrogen content of the solvent such that coking will eventually occur. Moreover, a higher solvent quality is needed at higher reaction temperatures wherefore operation at high temperatures is more difficult and more expensive to achieve.

EXAMPLES 11-13

A major consequence of inadequate pasting oil quality (hydrogen donor capacity) is the formation of coke from SRC or directly from the coal. In laboratory tests on a continuous stirred tank reactor, CSTR, this coking is manifested as an increased yield of pyridine-insoluble organic residue, that is generally lumped with unconverted coal. This can be confirmed as coke by petrographic examination of the pyridine-insoluble reaction residue in which the coke is readily identified under polarized light. The following examples indicate that coke formation is much more pronounced at elevated reaction temperature and that poor pasting oil quality exacerbates this problem. All of the data is collected in the CSTR reactor following the experimental procedure outlined in Examples 1-8 and using KY 9/14 coal (Table I) and a superficial liquid hourly space velocity of 3 hours$^{-1}$. A blend of hydrotreated creosote oil/creosote oil (HTCO) (Table II) was used as a good pasting oil and untreated creosote oil (CO) Table V) is the pasting oil of inadequate quality.

TABLE V

| Composition of Creosote Oil Solvent | | | | | |
|---|---|---|---|---|---|
| | | Elemental Analysis (wt %) | | | |
| Fraction | wt. % | Carbon | Hydrogen | Nitrogen | Sulfur |
| IBP-420° F. | 0.4 | 89.9 | 7.6 | 0.3 | — |
| 420-550° F. | 38.4 | 90.7 | 6.8 | 1.2 | — |
| 550-850° F. | 54.3 | 91.6 | 5.8 | 0.6 | — |
| 850° F.+ | 6.9 | 89.4 | 5.0 | 2.1 | 0.7 |

TABLE VI

| Example | 11 | 12 | 13 |
|---|---|---|---|
| wt. % coal | 39 | 39 | 20 |
| Solvent | HTCO | HTCO | CO |
| Temperature, °F. | 815 | 885 | 890 |
| Pressure, psig | 2000 | 2000 | 2000 |
| Coal Conversion | 89 | 91.5 | 89 |
| Coke Yield, wt. % maf coal | 0.3 | 0.8 | 2.0 |
| wt. % coke in residue | 1.3 | 3.9 | 11.3 |

As shown in Table VI, at a moderate reaction temperature of 815° F., coke yield is very low (Example 11), being only 0.3 wt.%. This coke yield nearly triples when the reaction temperature is increased to 885° F. as in Example 12. Note, however, that at this high reaction temperature the coke yield with the poor quality pasting oil (Example 13) is 2½ times that with the good pasting oil (Example 12), even though the coal concentration has been reduced (which should reduce coking). This indicates that the proposed low temperature second dissolver, by improving the pasting oil quality, should permit the first dissolver to operate at a higher temperature than would otherwise be possible without excessive coke formation.

In addition to reducing the yield of desirable products, excessive coke formation will also interfere with normal operation of a coal liquefaction plant by plugging the fired preheater, taking up dissolver volume, and blocking valves and piping.

It will be evident that various changes may be made in the above-described process without departing from the scope of the invention. For example, three or more series-arranged dissolvers may be used. However, in accordance with the invention there will be a temperature quench at some location in the series of dissolvers to provide at least one dissolver operating at a high temperature and at least one dissolver operating at a low temperature as discussed hereinbefore. Thus, there may be two or more dissolvers prior to the quench or two or more dissolvers following the quench.

What is claimed is:

1. In a process for the solvent refining of coal wherein a slurry of finely ground coal in recycle process solvent is passed through a preheater to a coal liquefaction stage in the presence of hydrogen-rich gases at elevated temperatures and pressures, the improvement wherein said coal liquefaction stage comprises passing the slurry from the preheater in series through a first dissolver and a second dissolver, the process being controlled so that said first dissolver is operated at a higher temperature than said second dissolver, said first and second dissolvers not containing a fixed or ebullated catalyst bed and being operated in an adiabatic mode without the addition of significant external heat, the higher operating temperature of said first dissolver being more favorable for the liquefaction reactions of desulfurization and solvent production, and the lower operating temperature of said second dissolver being more favorable thermodynamically for solvent hydrogenation.

2. A process according to claim 1 wherein the process is controlled so that the temperature at the outlet of the preheater is less than the outlet temperature of the first dissolver.

3. A process according to claim 1 wherein the operating temperature for said first dissolver is at least approximately 840° F., and the operating temperature of said second dissolver is approximately 25° F. less than the operating temperature of the first dissolver.

4. A process according to claim 3 wherein fresh hydrogen is added to the effluent from said first dissolver prior to entering said second dissolver under conditions to lower the temperature of said effluent.

5. A process according to claim 1 wherein the operating temperture of said second dissolver is approximately 25° F. less than the operating temperature of said first dissolver.

6. A process according to claim 5 wherein the lower operating temperature of said second dissolver is achieved by passing the effluent from the first dissolver through a cooling heat exchanger prior to entering the second dissolver.

7. A process according to claim 5 wherein the lower operating temperature of said second dissolver is achieved by adding hydrogen gas to the effluent from said first dissolver prior to entering the second dissolver, the temperature and volume of the hydrogen gas serving to lower the temperature of said effluent the desired amount.

8. A process according to claim 5 wherein the lower operating temperature of said second dissolver is achieved by passing the effluent from the first dissolver through a cooling heat exchanger prior to entering the second dissolver and by adding to said effluent hydrogen gas under conditions to cause a lowering of the temperature of said effluent.

9. A process according to claim 3 wherein the lower operating temperature of said second dissolver is achieved by passing the effluent from the first dissolver through a cooling heat exchanger prior to entering the second dissolver.

10. A process according to claim 1 wherein the maximum temperature of said second dissolver is maintained to be at least 25° F. lower than the maximum temperature in said first dissolver.

11. A process according to claim 10 wherein a gas separator is positioned between the first dissolver and the second dissolver, the underflow of said separator is fed to the second dissolver and a fresh hydrogen stream is added to said underflow.

12. A process according to claim 1 wherein the lower operating temperature of said second dissolver is achieved by passing the effluent from the first dissolver through a gas separator and a cooling heat exchanger prior to entering the second dissolver, together with a fresh stream of hydrogen.

13. A process according to claim 5 wherein said high temperature first dissolver is smaller in cross-sectional flow area than said low temperature second dissolver.

14. A process according to claim 1 including the step of passing the effluent from the second dissolver through at least one more dissolver.

15. A process according to claim 1 the wherein residence time in said first dissolver is less than the residence time in said second dissolver.

* * * * *